United States Patent [19]

Pavel

[11] 4,117,930

[45] Oct. 3, 1978

[54] PACKING RECEPTACLE FOR SEWING MACHINE NEEDLES

[75] Inventor: Klaus Pavel, Eynatten, Belgium

[73] Assignee: Rhein-Nadel Maschinennadel GmbH, Aachen, Fed. Rep. of Germany

[21] Appl. No.: 821,775

[22] Filed: Aug. 4, 1977

[30] Foreign Application Priority Data

Apr. 1, 1977 [DE] Fed. Rep. of Germany ... 7710391[U]

[51] Int. Cl.[2] ..... B65D 85/24

[52] U.S. Cl. ..... 206/382; 206/443

[58] Field of Search ..... 206/380, 382, 383, 379, 206/443; 220/8; 229/9, 10, 19

[56] References Cited

U.S. PATENT DOCUMENTS

| | | | |
|---|---|---|---|
| 337,893 | 3/1886 | Toof | 206/380 |
| 2,817,434 | 12/1957 | Schmetz et al. | 206/380 |
| 3,004,660 | 10/1961 | Hofmann | 206/382 |
| 3,227,265 | 1/1966 | Schneider | 206/382 |

*Primary Examiner*—William T. Dixson, Jr.
*Attorney, Agent, or Firm*—Martin A. Farber

[57] ABSTRACT

A packing receptacle for sewing machine needles, with an upper part constructed in the form of a flat cap, in its opening which is provided on one side, a stay-shaped lower part is positively clampingly inserted, the lower part carrying the needles, the latter being inserted in row-form adjacent one another, such that a partial surface of the stay-shaped lower part is exposed as a consequence of gripping recesses provided in the cap-shaped upper part. One of the side walls of the cap-shaped upper part projects over the opening-sided edge of the other side wall surface. The latter side wall has a slot, which slot connects to the gripping recess.

10 Claims, 6 Drawing Figures

PACKING RECEPTACLE FOR SEWING MACHINE NEEDLES

The invention relates to a packing receptacle for sewing machine needles, with an upper part constructed in the form of a flat cap, in its opening which is provided on one side, a stay-shaped lower part is positively clampingly inserted, the lower part carrying the needles, the latter being inserted in row-form adjacent one another, such that a partial surface of the stay-shaped lower part is exposed as a consequence of gripping recesses provided in the cap-shaped upper part.

Packing receptacles and retainer receptacles, respectively, of this type are particularly still in need of improvement with respect to handling. Thus the recoordination of the lower part forming the needle magazine is made more difficult insofar as first of all with small packages it still requires some skill in order to introduce the relatively flat lower part into the very narrow opening of the upper part. An increased difficulty in this manner constitutes, not the least, the fact that the flat cap is made of a transparent material - it thus lacks an optically sufficiently distinct opening contour. Furthermore the gripping recesses which lie in the range of the opening have only a small niche depth which naturally excludes a secure fastening of the lower part which is to be removed or to be inserted. The provision of deeper gripping recesses however appears disadvantageous insofar as with the known construction forms, the stay-shaped lower part which carries the row-aligned needles which are inserted adjacent one another, receives the needles mutually or reciprocally exposed (similar to the known paper carriers), so that the strived for mechanical protection as well as protection from chemical influences would no longer be performed by the cap wall in the absence of a closed full-surface covering. The lower part with these construction forms is made of a molded part produced in plastic injection molding processes, which on its end range coordinated to the thickened needle shaft end forms the runners projecting above the common cross-sectional thickness of the stay-shaped lower part, which runners cooperate as clamping projections with the cap inner wall after underpinning or undercutting of the gripping recess edge. Also the clamping action which immediately occcurs as a consequence already at the beginning of the assembling coordination impairs the simple assembling coordination.

It is an object of the present invention to provide here remedial measures and to produce a packing receptacle of the introductory mentioned type which is simple in construction and operation, and makes possible an advantageous, protected application of needle and needle-like storage goods, respectively.

It is another object of the present invention to aid in the solution of the above mentioned object in the manner that one of the side walls 4 of the cap-shaped upper part 1 projects over the opening-sided edge 3' of the other side wall 3, which latter side wall has a slot 14 interrupting the side wall surface, the slot joining onto the gripping recess 10.

As a result of such a formation, a packaging receptacle and retainer receptacle, respectively, is produced of increased utility: By the simple peripheral edge off-setting of the side walls, a favorable orientation edge and abutment edge, respectively, are achieved for the easy insertion of the lower part. The insertion opening is enlarged in a practical manner. The thickened projecting needle shafts form the sensor projections. The corresponding orientation aid is also provided with an incompletely filled magazine or storage. The slot which interrupts one of the cap side wall surfaces fulfills in this manner a double function. On the one hand it makes one of the side walls flexible so that greater clamping forces can be achieved for the securing of the plug-in insertion coordination; and on the other hand it forms the same type of the explained plug-in coordination-aid in the situation if for example still only one or a few needles stick in the lower part. The remaining needle series is inserted over or via the slot perpendicularly to the plane of the cap and in this manner is angled in the plane of the cap. The closed other cap wall thus forms on the other hand a projection, as it is realized in accordance with the invention, in the range of the cap opening by the there present narrow lateral tongues.

With a packing receptacle for sewing machine needles, with an upper part shaped in the form of a cap, in the opening of which a stay-shaped lower part is inserted, which lower part carries needles inserted opposite one another in row-form, it is further of advantage in accordance with the present invention that the stay-shaped lower part is made of polystyrene foam and the needles are seated in a clamping seat in the insertion openings of the stay-shaped lower part, in which insertion openings the needles themselves pierce in. Lower parts of this type compared to construction parts executed as injection molded parts have the considerable advantage of lower production costs. Also the clamping seat or fit may be achieved more simply as a result of the considerable compressibility of the material. Its restoring force causes a large surface clamping contact inside of the upper part. Of completely considerable advantage is the manufactured uses: the stay can now be supplied as a complete strip to the dealer, who inserts the needles from the front side. Such a strip can have nominal breaking points, so that the filling units may easily be put together. Each needle is individually and rigidly fixed. Point, eye and groove parts are embedded in the surrounding material and are thus protected against pressure and jolts, further also optimumly against mechanical and chemical influences. The length equalization of the needles of different systems is simply regulated by the insertion depth in the stay-formed lower part.

By the further met measure that according to the invention the narrow side walls of the upper part are formed opaque, for example matted, frosted or dulled, under the circumstances, the coarse occurring bend or break-off zones of the lower part are directly removed from sight, so that from here an attractive exterior is provided. The matting can be taken into consideration immediately during injection molding of the upper part.

In the manner that further in accordance with the present invention the spacing between the wide side walls of the cap-shaped upper part narrows toward the cap cover, the clamping seat still further is improved insofar as in a practical manner a funnel-shaped cap body is present. This also is compatible with injection molding interests.

In the manner that finally in accordance with the present invention the gripping recesses are formed semicircularly and approximately in fingertip sizes, the lower part may be surely positively gripped, and coordinated without problem, and withdrawn from the protective cavity of the upper part, respectively.

With the above and other obejcts in view the present invention will become more clearly understood from the following detailed description of a preferred embodiment of the present invention in connection with the accompanying drawing, of which:

Figure 1:
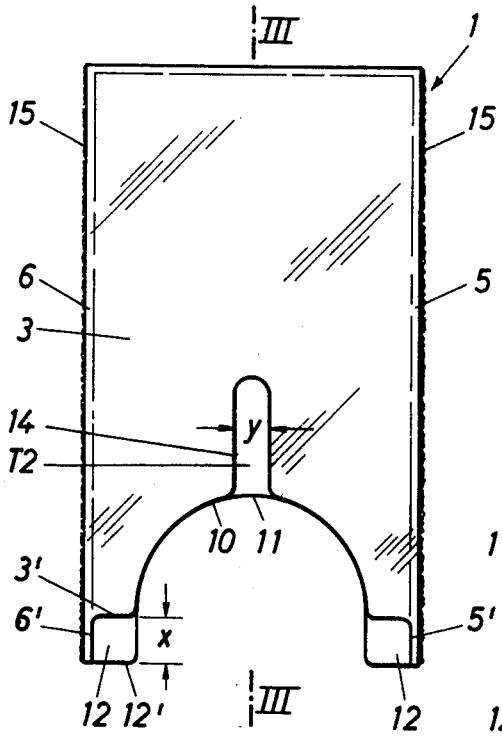
FIG. 1 is a plan view of the upper part of the packing receptacle formed in accordance with the present invention.

Referring now to the drawings, the packing receptacle and depository receptacle, respectively, comprises an upper part 1 constructed in the form of a flat cap or hood and a lower part 2 insertable in the upper part 1.

The upper part 1 is made of a transparent material for the identification of its contents without the necessity of an opening therefor, and is preferably produced by injection molding processes. Polystyrene serves as the production material, although not limited thereto. The upper part 1 possesses two wide or broad side walls 3 and 4 as well as two narrow side walls 5 and 6. The cover 7 is rounded in the transverse direction of the receptacle.

On the side opposite to the cover 7, the upper part 1 forms an opening 8 for the insertion of the lower part 2, in which lower part 2 there are provided sewing machine needles 9. The lower part 2 is designed stay-shaped and enters into a positive clamping connection with the upper part 1 without slipping. It fills out and occupies the hollow width of the latter and occupies approximately half the height of the upper part 1. In order to facilitate the coordination and removal, the wide side walls 3 and 4 of the upper part are designed such that the partial surface T1 of the stay-shaped lower part 2 is exposed. The corresponding gripping or engaging recesses 10 and 11 are formed in the wide side walls 3 and 4. One of the side walls 4 projects beyond the opening-sided edge 3' of the other side wall 3. This projection X produces narrow lateral tongues 12 lying in the direct vicinity of and adjacent to the narrow side walls 5 and 6. The narrow side walls terminate with the lower edge 12' of the tongues 12 at the same level and project with formation of rounded narrow edges 13 into the rearwardly off-set wide side wall 3, the latter here forming the front wall. This off-setting of the wall sections makes a larger shoe-like orientation abutment surface, which facilitates the insertion of the needle-equipped lower part, formed by the lateral tongues 12 and the narrow side wall sections 5' and 6' extending perpendicularly thereto.

Figure 6:
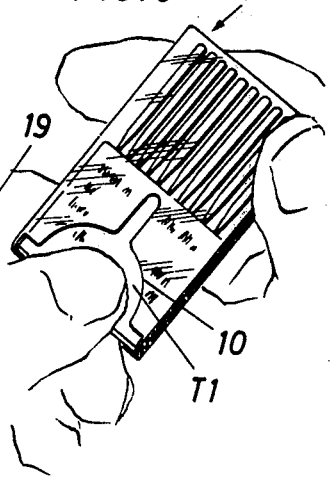
FIG. 6 is a perspective view of the closed packing receptacle in approximately natural scale with sketched illustration of the opening handling.

The other wide side wall 3 is formed with a slot 14 interrupting the cap side wall surface, which slot 14 extends in the longitudinal center plane of the upper part 1 and originates from the gripping recess 10 of the wide side wall 3. The width $y$ of the slot 14 is larger than the diameter of the needle shafts. The inner end of the slot 14 is rounded; likewise the transfer point into the semi-circular formed gripping recess 10 is rounded. The gripping recesses 10 and 11 are dimensioned such that the thumb tips can comfortably grip the exposing partial surface T1, that is in a full surface-wise manner (compare FIG. 6).

The partial surface T2 of one of the wide side walls, which partial surface T2 is exposed by the slot 14, performs an abutment function corresponding to the tongues 12, for example when only a remainder or residual quantity of sewing machine needles 9 are still disposed in the lower part 2. The user can then selectively make use of the slot opening 14 for the properly inserted positionings of the lower part or make use of the tongues 12. The depth of the slot 14 is dimensioned with respect to the upper edge 2' and the selected exposure of the needle shafts such that with central remainder conditions in spite of the support of the lower part on the tongues 12, a coordination which is perpendicular to the wide side wall surface is possible. With the lateral residual condition, the remaining residual-needle series can be angled-in via the slot 14.

The partial slotting of the wide side wall 3 makes the latter flexible so that an improved clamping securing is achieved.

The stay-shaped lower part 2 is produced of polystyrene foam. The use for example of Styropore or Styrofoam (rigid expanded polyurethane or plastic) likewise contributes to the improvement of the clamping connection, since such a hard foam R (rigid polyurethane or plastic) is compressible and the restoring force can be used for the formation of a large or wide surfaced clamping face.

The sewing machine needles are disposed with a clamping fit in insertion openings 16 of the lower part 2, the latter being made of hard foam, i.e., rigid expanded plastic material, the insertion openings being pierced by the needles 9 themselves. This type of coordination (using of the restoring force of the displaced foam or porous material) provides a secure holding of the needles 9. The thickened needle point zone 18 of the needles which have the eye 17 provides an additional advantageous anchoring effect. The relatively fragile material is reinforced by the inserted needle sections. Different needle lengths may be regulated, by using corresponding insertion depths, such that a uniform exposed conditon is provided for all needles. Labels 19 glued on the wide surfaces of the lower part, providing information concerning the articles, manufacturer, etc., provide an additional protection against breaking. The automatic equipping, first of all is also facilitated if one starts out from a band shaped endless blank as a basic body for formation of the lower part. The nominal breaking points occuring mostly not so smooth and defining for example a ten-pack, are covered in the package by the opaque held narrow side walls 5 and 6 of the upper part. This here can concern a frosting, dulling or ridging in the form of a coarseness or uneveness 15 which is taken into consideration during the injection molding of the construction part. Also the perforation edges of the labels 19 which are likewise coordinateable in bands may be covered in this manner.

Figure 3:
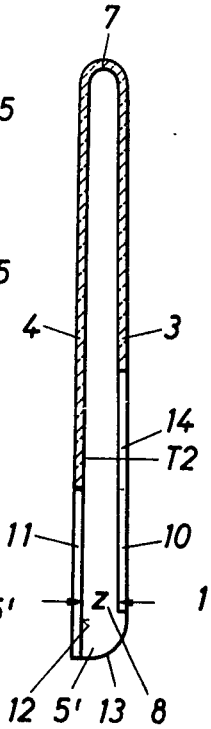
FIG. 3 is a section taken along the lines III—III of FIG. 1.
Figure 4:
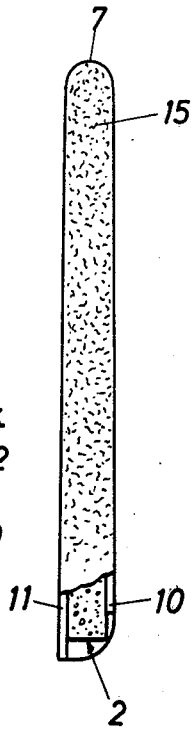
FIG. 4 is a side view of the upper part.
Figure 2:
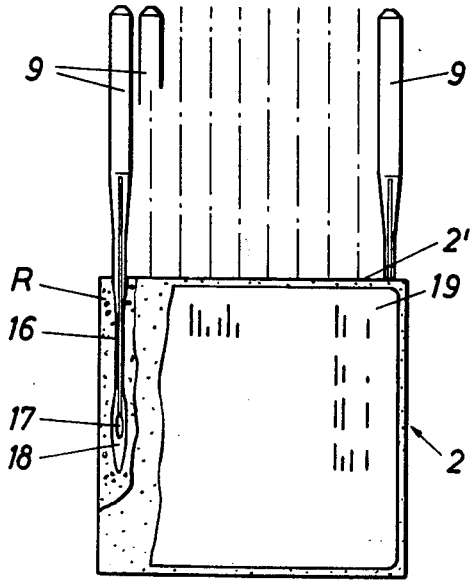
FIG. 2 is a view of the needle equipped lower part of the same, partially broken away in section.
Figure 5:
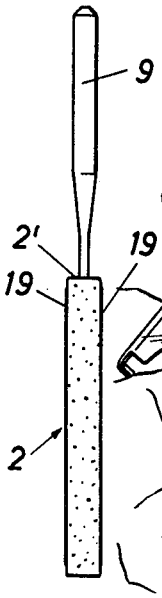
FIG. 5 is a side view of the lower part.

As evident from FIG. 3, the spacing Z between the wide side walls 3 and 4 of the cap-shaped upper part 1 narrows in the direction toward the cap cover 7.

The cross-section of the stay-shaped lower part is slightly smaller than the distance measure Z, so that the clamping effect is not directly effective already during the insertion of the lower part, but rather only after a certain insertion depth is reached.

The packing receptacle in accordance with the present invention can also serve for the protected shielded placement of other rod shaped goods, such as for example injection needles, drills, or the like.

While I have disclosed one embodiment of the present invention, it is to be understood that this embodiment is given by example only and not in a limiting sense.

I claim:

1. A packing receptacle for sewing machine needles, comprising an upper part having the shape of a flat cap and having spaced apart wide side walls defining at one end thereof an opening therebetween and gripping recesses, respectively, adjacent said opening, said side walls being off-set in part relative to each other, one of said side walls has lateral opening-sided edges on opposite sides adjacent said opening, respectively, a stay-shaped lower part being in the form of a platelet releasably positively clampingly insertable in said opening of said upper part between said wide side walls, said lower part being adapted to carry sewing machine needles, the latter being inserted in said lower part in a row series and adjacent one another, said stay-shaped lower part has a partial surface exposed by said gripping recesses, respectively, in an inserted position of said lower part in said upper part, the other of said side walls of said upper part forms projections constituting narrow lateral tongues, a corresponding of said gripping recesses extends between the latter, said lateral tongues lying opposite to and projecting beyond said opening-sided edges of said one side wall, said one side wall being formed with a slot therein interrupting the surface of said one side wall therethrough, said slot extending to a corresponding of said gripping recesses, said other side wall having a wall section lying behind and opposite to said slot operatively constituting a central orientation abutment surface for the needles, said upper part including narrow side walls each extending perpendicularly to and connected to both of said wide side walls, said narrow side walls including lower side wall portions connected to and extending perpendicularly to said lateral tongues and said opening-sided edges, said opening-sided edges of said one side wall and said lower side wall portions forming a catch opening laterally communicating with and enlarging the corresponding of said gripping recess in said one side wall, said lateral tongues and said lower side wall portions facing said catch opening and operatively constituting lateral shoe-like orientation abutment surfaces on opposite lateral sides of the corresponding of said gripping recess for the needles.

2. The packing recptacle, as set forth in claim 1, wherein said narrow side walls are opaque.

3. The packing receptacle, as set forth in claim 2, wherein said narrow side walls are frosted.

4. The packing receptacle, as set forth in claim 1, wherein said upper part includes a cap cover portion connected to said side walls at an end of said upper part opposite from said one end of said opening, said wide side walls converge in a direction toward said cap cover portion, said stay-shaped lower part is formed of a compressible material and has a thickness slightly wider than a widest spacing between said wide side walls adjacent said opening, whereby a clamping of said lower part by said upper part arises when said lower part is inserted into said upper part in the inserted position.

5. The packing receptacle for sewing machine needles, as set forth in claim 4, wherein said lower part is made of a material selected from the group consisting of polystyrene foam and polyurethane foam, said stay-shaped lower part is foamed with a plurality of stick-in opening means for receiving said needles in clamping seated disposition without substantial change of the outer shape of said lower part, whereby a constant clamping of said lower part by said upper part is present in the inserted position independent of the number of needles received in said stick-in opening means.

6. The packing receptacle, as set forth in claim 5, wherein said stick-in opening means comprises preformed openings in said stay-shaped lower part, said preformed openings are slightly smaller than needle points to be inserted therein.

7. The packing receptacle, as set forth in claim 1, wherein said gripping recesses are semicircular and are substantially the size of a finger tip.

8. The packing receptacle, as set forth in claim 1, wherein said slot is centrally disposed longitudinally in said one side wall and has a width greater than the diameter of one needle shaft, said slot has an inner rounded end and is rounded transferring into said corresponding gripping recess, and said upper part is made of plastic.

9. The packing receptacle, as set forth in claim 1, wherein said lower side wall portions of said narrow side walls are convexly rounded extending from said opening-sided edges to a lower free end of said lateral tongues, respectively.

10. The packing receptacle, as set forth in claim 1, wherein said stay-shaped lower part occupies substantially half the height of said upper part in the inserted position therein, said slot has an upper end substantially disposed adjacent an upper edge of said lower part in said inserted position.

* * * * *